US006742286B2

(12) United States Patent
Giovale

(10) Patent No.: US 6,742,286 B2
(45) Date of Patent: Jun. 1, 2004

(54) FLEXIBLE TRACTION SYSTEM FOR COMMON SHOES

(75) Inventor: Daniel G. Giovale, Flagstaff, AZ (US)

(73) Assignee: Kahtoola, Inc., Flagstaff, AZ (US)

( * ) Notice: Subject to any disclaimer, the term of this patent is extended or adjusted under 35 U.S.C. 154(b) by 21 days.

(21) Appl. No.: 10/053,049

(22) Filed: Jan. 17, 2002

(65) Prior Publication Data

US 2002/0095820 A1 Jul. 25, 2002

Related U.S. Application Data

(60) Provisional application No. 60/263,995, filed on Jan. 23, 2001.

(51) Int. Cl.[7] ..... A43B 15/00; A43B 3/10

(52) U.S. Cl. ..... 36/7.6; 36/7.7; 36/7.5; 36/97; 36/62

(58) Field of Search ..... 36/7.6, 7.7, 7.5, 36/97, 59 R, 62, 122, 123, 124, 125

(56) References Cited

U.S. PATENT DOCUMENTS

| | | | | | |
|---|---|---|---|---|---|
| 1,008,286 | A | * | 11/1911 | Soderburg | 36/7.6 |
| 1,103,108 | A | * | 7/1914 | Van Wie | 36/7.7 |
| 1,336,276 | A | * | 4/1920 | Brightwell | 36/7.6 |
| 2,130,971 | A | * | 9/1938 | Snyder | 36/7.7 |
| 2,162,928 | A | * | 6/1939 | Arieti | 36/7.6 |
| 2,441,998 | A | * | 5/1948 | Fisher | 36/7.6 |
| 3,095,657 | A | * | 7/1963 | Fradette | 36/7.6 |
| 3,229,389 | A | * | 1/1966 | Adams | 36/7.6 |
| 3,685,173 | A | * | 8/1972 | Piazza | 36/7.6 |
| 3,795,993 | A | | 3/1974 | Simond | |
| 4,005,533 | A | | 2/1977 | Anderson | |
| 4,221,029 | A | | 9/1980 | Jerome | |
| 4,338,733 | A | | 7/1982 | Frechin | |
| 4,344,238 | A | * | 8/1982 | Peyser | 36/7.6 |
| 4,351,121 | A | | 9/1982 | Wallace | |
| 4,353,172 | A | | 10/1982 | Bryant | |
| 4,620,375 | A | * | 11/1986 | Wallace | 36/7.6 |
| 4,727,662 | A | * | 3/1988 | Ilon | 36/132 |
| 4,910,883 | A | | 3/1990 | Zock | |
| 5,259,128 | A | * | 11/1993 | Howell | 36/122 |
| 5,740,621 | A | * | 4/1998 | Wing et al. | 36/122 |

(List continued on next page.)

FOREIGN PATENT DOCUMENTS

| | | |
|---|---|---|
| EP | 0 019 565 | 12/1982 |
| EP | 0 232 210 | 8/1987 |
| EP | 0 233 130 | 8/1987 |
| EP | 0 155 896 | 9/1987 |
| EP | 0 258 602 | 3/1988 |
| EP | 0 258 603 | 3/1988 |
| EP | 0 300 244 | 1/1989 |
| EP | 0 334 299 | 9/1989 |
| FR | 2555872 | * 12/1983 |
| WO | 93/25106 | * 12/1993 |
| WO | WO 98/36654 | 2/1997 |

OTHER PUBLICATIONS

Collection of Web Site Printouts from the Year 2000.
Grivel Cataloge, 1984.

*Primary Examiner*—M. D. Patterson
(74) *Attorney, Agent, or Firm*—Connolly Bove Lodge & Hutz LLP

(57) ABSTRACT

A traction system for use on conventional flexible footwear is provided that includes both toe and heel sections that are independently attached to a wearer's footwear and are connected with a flexible linkage. The flexible linkage allows the traction system to move with the normal movement of the flexible footwear so as to provide a natural walking and running movement. The traction system provides numerous benefits over previously available crampon and other spiked traction systems, including flexibility, light weight, practical usability with a wide variety of footwear types—including highly flexible footwear such as running shoes, compactability, and ready adjustability between different sizes and types of footwear.

34 Claims, 21 Drawing Sheets

U.S. PATENT DOCUMENTS 5,787,612 A 8/1998 Mahoney
5,794,360 A * 8/1998 Bell et al.
5,823,563 A 10/1998 Dubuque
5,901,471 A * 5/1999 Warner ..... 36/124
5,950,334 A * 9/1999 Gerhardt ..... 36/59 R
5,970,632 A * 10/1999 Watson ..... 36/122

* cited by examiner

FLEXIBLE TRACTION SYSTEM FOR COMMON SHOES

CROSS REFERENCE TO RELATED APPLICATION

This application is based upon provisional applications Ser. No. 60/263,995, filed Jan. 23, 2001 and Serial No. 60/335,659, filed Oct. 23, 2001.

BACKGROUND OF THE INVENTION

1. Field of the Invention

The present invention relates to devices, such as crampons, adapted to be worn over footwear to provide improved traction.

2. Description of Related Art

There are a variety of devices available today for attachment to footwear to improve traction. It is very common for hikers in snowy or icy environments to employ crampons that attach to bottom of their stiff-soled hiking boots. These heavy-duty devices typically provide series of 1 to 2 inch long spikes across the forefoot and heel of the boot. The spikes are adapted to penetrate ice, snow, and/or loose dirt to provide improved sure-footed hiking or climbing.

A typical crampon is constructed with 8 to 12 spikes attached around the footbed of a relatively inflexible frame. The spikes may be oriented downward and at various outward-facing angles to address traction needs in climbing or descending extreme terrain. Since these devices are adapted to be attached to hiking boots that have soles that may readily flex only 5 to 10 degrees from normal plane, a conventional crampon is constructed from a coherent material, such an inflexible polymer or metal, that can be easily flexed by hand only about 0 to 5–7 degrees off its normal plane. In fact, for extreme climbing conditions, it is desirable to provide a crampon that provides virtually no flexibility so that proper foothold can be maintained under intense pressure.

While conventional crampons work well for their intended hiking and climbing applications, they have numerous deficiencies. First, due to their inflexible nature, most crampons must be worn with boots having very stiff soles. This makes use with common shoes (such as street shoes and boots, running and other athletic shoes, flexible soled hiking boots and shoes, or flexible soled winter boots) quite uncomfortable since the wearer will not be adequately protected from the uneven nature of the crampon bed. Second, the strapping systems for conventional crampons are normally adapted only to attach to large stiff boots. These straps generally do not easily attach to smaller and more flexible common shoes. In fact, since a typical street shoe is quite flexible, flexing readily 45 degrees or more off normal plane, such shoes may slide out of a conventional crampon strapping system.

In order to provide improved traction for more conventional footwear, a number of other solutions have been suggested. A number of manufacturers sell crampon-like devices that are adapted to be attached to only the front (that is, forefoot region) of a shoe or boot. One such device is sold under the trademark SNOWTRACKER by Atlas Co., of San Francisco, Calif. Another commercially available system comprises a two-part device that has a first portion that attaches to the forefoot region on a shoe and a separate second portion that attaches to the heel region of the shoe. While these device do provide improved traction on snow and ice, they are believed to be lacking in attachment ease and security. For example, none of these devices provides a sufficiently secure attachment to withstand the rigors of running.

There are several commercial devices that comprise one or more rubber straps with metal nubs that attach over shoes for improved traction. One such device is sold under the trademark YAKTRAX by Yaktrax Inc. of Washington. These devices are deficient in that they are often shoe size-specific and typically provide only marginally improved traction. Additionally, these devices have a tendency to slip out of position when worn, particularly when encountering stress and strain. Finally, these devices are not designed or constructed for extended wear and intense use that might be required for extended walking, hiking, or running.

A number of patents have been issued related to crampons and similar traction devices. U.S. Pat. No. 4,344,238 describes a traction device that is adaptable to a variety of footwear, but has a strap system that is believed to be inadequate for vigorous activity. Other traction systems are described in U.S. Pat. Nos. 3,795,993, 4,910,883, 5,359,789, and 5,787,612. None of these previous systems is believed to be entirely suitable in one or more of the following design criteria: compaction for storage; light weight; secure attachment and flexibility for active walking and running activities; and/or ready adjustability for use on a wide variety of footwear.

SUMMARY OF THE INVENTION

The present invention is an improved traction system that is adapted for use with common flexible footwear, such as street shoes, running shoes and lightweight hiking boots.

One embodiment of the present invention provides a traction system oriented in a normal plane and adapted to be attached to common footwear that includes a forefoot region having multiple spikes and a heel region having multiple spikes. A flexible linkage is provided between the forefoot region and the heel region that allows the forefoot region and the heel region to be readily flexed relative to each other at least 20 degrees from normal plane, and more preferably 45 degrees or more from normal plane. A strap attachment system is provided to secure the traction system to common footwear.

In a further embodiment of the present invention, an improved strapping system for attaching a device to footwear is provided comprising a strap guide having multiple openings therein; a toe piece on the device having at least four strap anchors attached thereto, each corresponding with an opening in the strap guide; and at least two individually length-adjustable straps, attached through the strap guide to at least two of the strap anchors. The straps are adapted to be adjusted to position the strap guide in a secure position over a wearer's forefoot region.

The present invention provides numerous benefits, such as: being quickly attached and removed from footwear; being readily adaptable for use with different sizes and types of footwear; being readily flexible along its length to allow for use with footwear with flexible footbeds; being fully compactable for ease in carrying and storage when not in use; and being durable enough to accommodate aggressive use, such as in extended walking, hiking and running activities. These and other benefits of the present invention will be appreciated from review of the following description.

DESCRIPTION OF THE DRAWINGS

The operation of the present invention should become apparent from the following description when considered in conjunction with the accompanying drawings, in which.

DETAILED DESCRIPTION OF THE INVENTION

Figure 1:
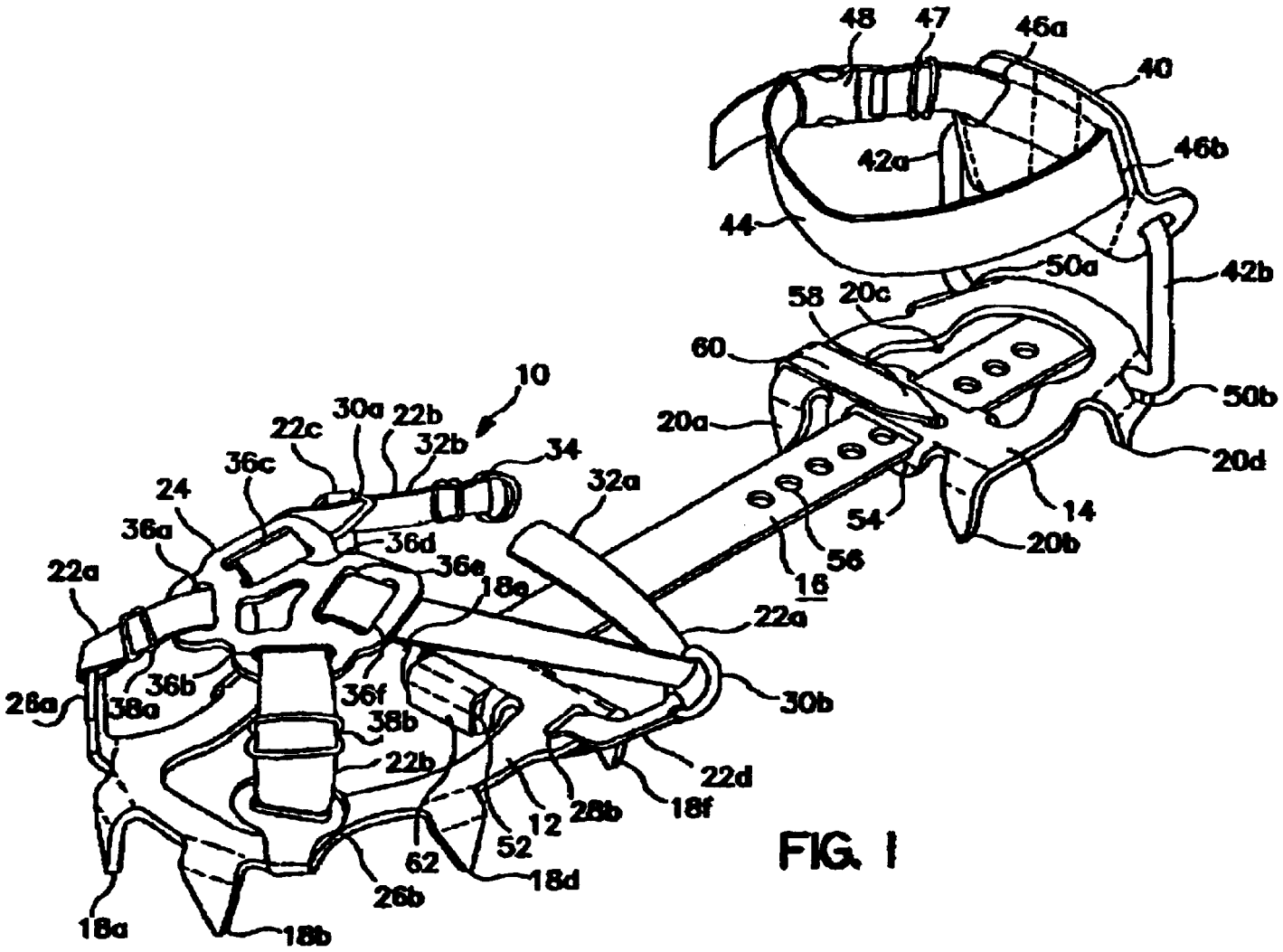
FIG. 1 is a three-quarter perspective view of a traction system of the present invention.
Figure 2:
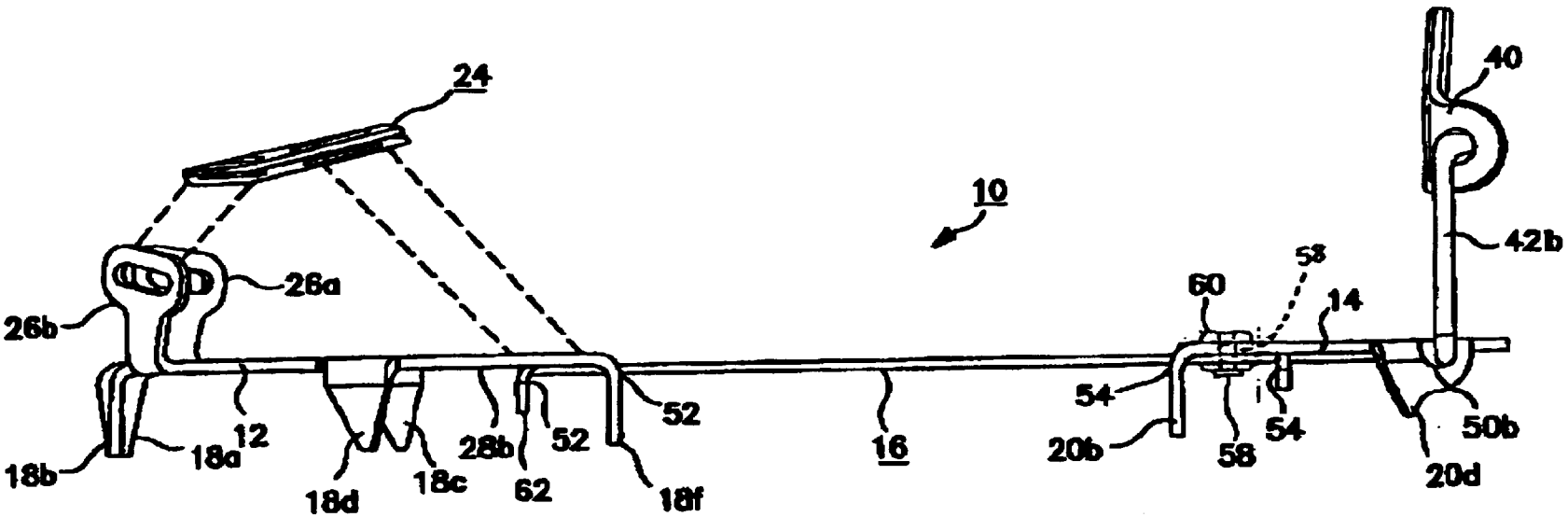
FIG. 2 is a left side view of the traction system of the present invention, with its straps removed for clarity (the right side view being essentially a mirror image thereof)
Figure 3:
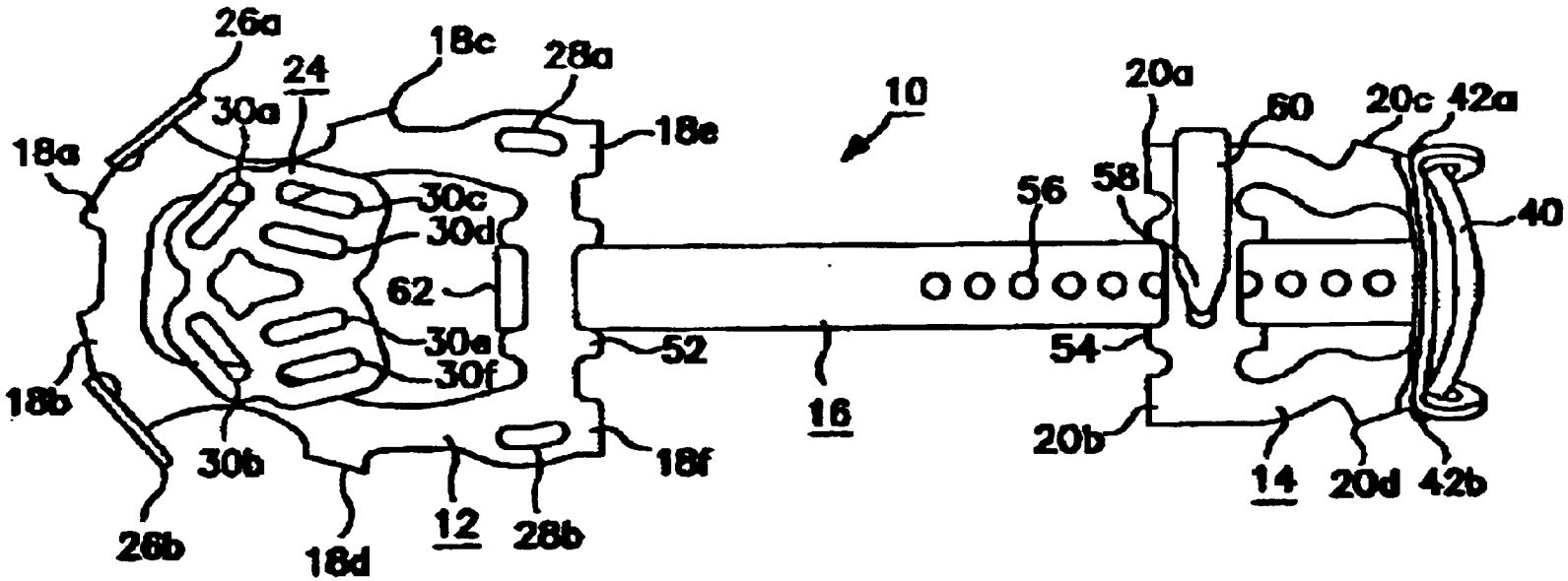
FIG. 3 is a top view of the traction system shown in FIG. 2.
Figure 4:
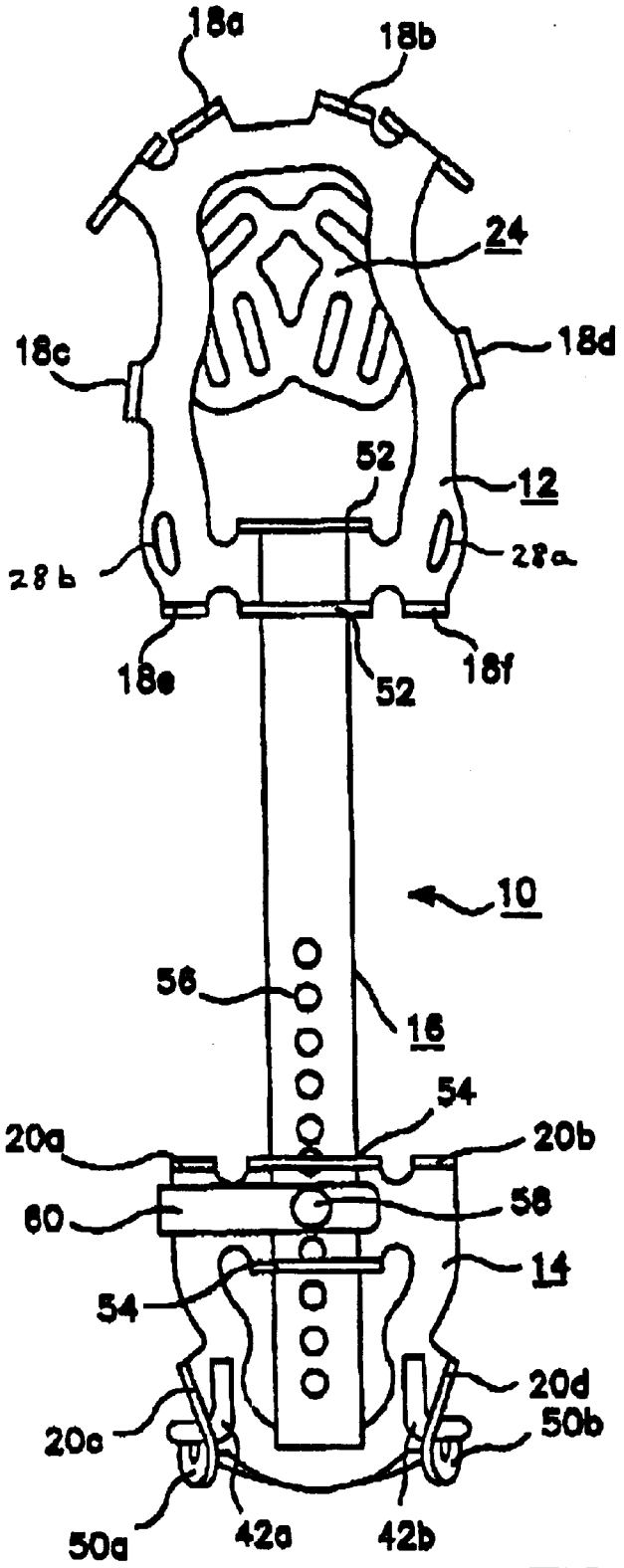
FIG. 4 is a bottom view of the traction system shown in FIG. 2.

The present invention comprises a traction system that is adapted for use with common footwear, such a street shoes, running shoes and lightweight hiking boots, that can provide one or more of numerous benefits, such as: being quickly attached and removed from footwear; being readily adaptable for use with different sizes and types of footwear; being readily flexible along its length to allow for use with footwear with flexible footbeds; being fully compactable for ease in carrying and storage when not in use; and being durable enough to accommodate aggressive use, such as in extended walking, hiking and running activities.

The traction system 10 of the present invention is illustrated in FIGS. 1 through 4. The traction system 10 comprises a toe piece 12 in the forefoot region, a heel piece 14, and a connecting extender bar 16 attaching the toe piece 12 and the heel piece 14 together. Each of the toe piece 12 and heel piece 14 has attached thereto or integral therewith numerous points or teeth 18*a*, 18*b*, 18*c*, 18*d*, 18*e*, and 18*f*, and 20*a*, 20*b*, 20*c*, and 20*d*.

The toe piece 12 is held to the forefoot of a wearer through the use of two or more straps 22*a*, 22*b* and a strap guide 24. Straps 22*a* and 22*b* are attached to the toe piece 12 by anchors, such as upwardly extending slotted tabs 26*a*, and 26*b*, and pass through slots in the strap guide 24 to produce two loose ends. As is explained in greater detail below, straps 22*a* and 22*b* are preferably formed from a flexible material, such as polypropylene or nylon.

Additional side support straps 22*c* and 22*d* attach to the toe piece through anchors such as slots 28*a* and 28*b*. Straps 22*c* and 22*d* are each attached to rings 30*a*, 30*b* (which can be circular, rectangular, triangular, oval, D-shaped, or other suitable shape). Although straps 22*c* and 22*d* may also be formed from flexible material, it has been determined that these straps are preferably formed from a relatively inflexible material, such as a metal or hard plastic, that can provide additional lateral support to the wearers foot during use. As is explained in greater detail below, depending on the width of footwear employed, these side support straps also can be adjusted to assume different orientations so as to provide either a wider supportive foot bed or more upright lateral support for the footwear.

The loose ends of straps 22*a* and 22*b* form toe attachment straps 32*a* and 32*b* adapted to fit through each of the rings 30*a*, 30*b* and adjustably attach around the wearer's foot, such as through the use of slide attachments (e.g., D-rings 34 as shown), hook-and-loop attachments, buckle attachments, etc.

The strap guide 24 includes openings 36*a* through 36*f* through which straps 22*a* and 22*b* are threaded to attached between slotted tabs 26*a* and 26*b*, rings 30*a* and 30*b*, and the attachments 34. The length of each of the straps 22 is preferably independently adjustable, such as through the use of slides 38*a* and 38*b* or other means (such as hook-and-loop fasteners, provision of multiple straps of different lengths, etc.), so that the strap guide 24 can be re-positioned to accommodate different sizes and/or types of footwear. Once properly positioned for a given footwear, the traction system can be quickly and easily applied. One or more additional adjustments may also be provided on the loose ends of straps 22 to add in the adjustment of the toe adjustment straps 32*a*, 32*b*.

It is believed preferred that the strap guide 24 be adjusted to seat over the wearer's foot just forward of the ball of the foot (as is shown in FIGS. 11 through 14). However, the adjustability of the straps 22 and strap guide 24 allows each user to position attachment of the toe piece 12 in a personally preferable manner.

It should be appreciated that the design of the present invention allows it to be readily adaptable to a wide variety of strap embodiments. For instance, the strap guide 24 may be attached to each of the slotted tabs 26*a*, 26*b* by separate straps (which can be independently adjustable). The toe adjustment straps 32*a* and 32*b* may then be formed from one or more separate straps independently attached to the strap guide 24.

The heel piece 14 is attached around a wearer's ankle through a heel cup 40 mounted above the heel piece 14 through one or more heel bales 42*a*, 42*b*. The heel cup 40 attaches against the wearer's Achilles tendon through use of an adjustable heel attachment strap 44 attached to the heel cup through slots 46*a*, 46*b*. The heel strap 44 is preferably adjustable, such as through use of slide 47 and/or other means (e.g., hook-and-loop fasteners) and/or adjustable buckle attachment 48. The heel bales 42 are shaped to allow the heel support to fold forward fully yet offer rigid support by stopping at near vertical (e.g., about 95–110 degrees) from the plane of the heel piece.

Figure 16:
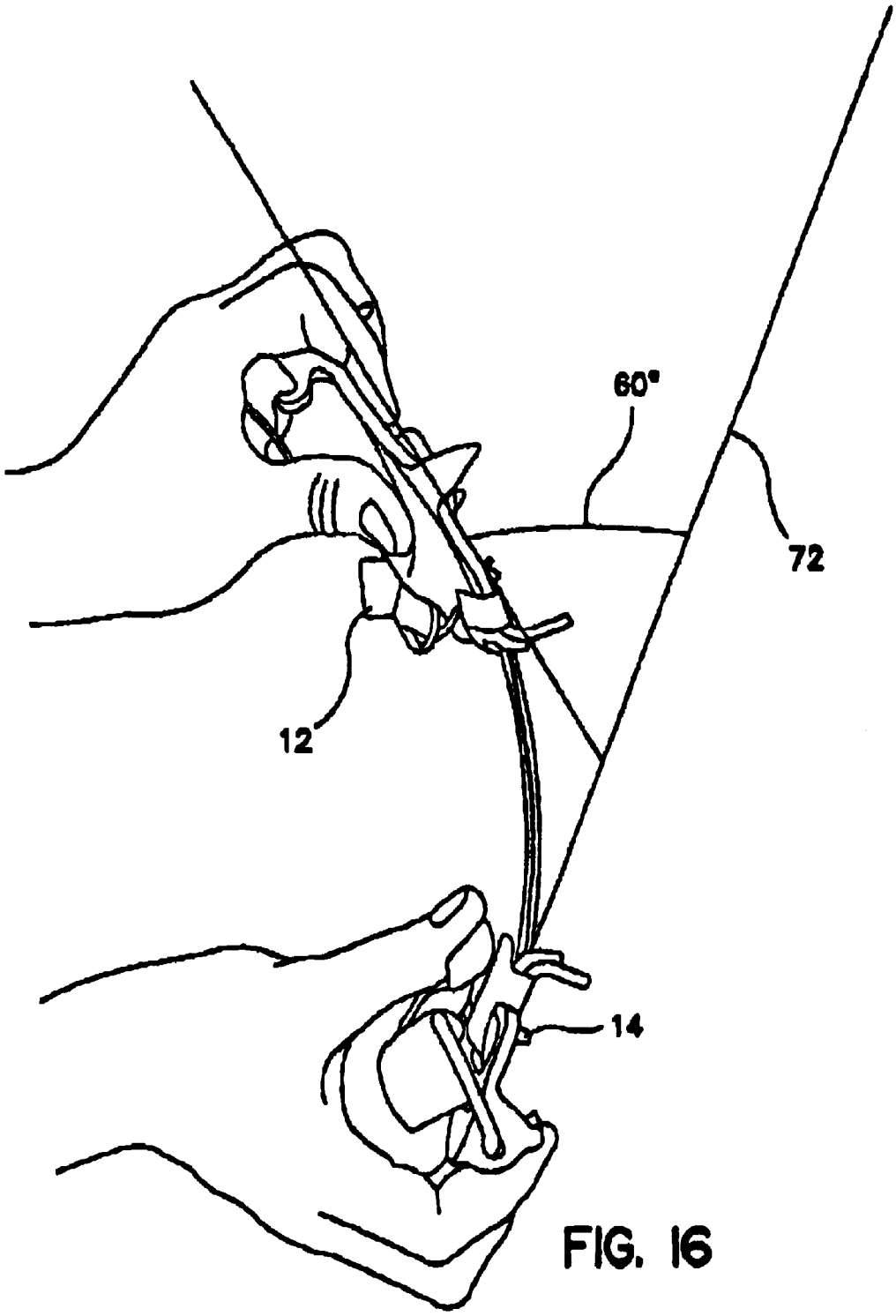
FIG. 16 is a side view of the traction system of the present invention shown flexed approximately 60 degrees off normal.

The heel bales 42 are preferably attached to the heel piece 14 through openings 50*a*, 50*b* in such a manner that the heel bales 42 can be actuated downward (that is, contacting against, and approximately parallel to the plane of, the heel piece) so that the heel cup 40 folds compactly against the heel piece 14 when not is use (as is shown in FIG. 16).

The extender bar 16 is preferably provided with means to adjust the distance between the toe piece 12 and the heel piece 14 to accommodate different lengths of footwear. This can be accomplished through a variety of methods, including providing multiple extender bars of different lengths or providing one or more of various clamping or locking means to fix the operative length of the extender bar.

In the preferred embodiment shown, the extender bar 16 attaches to the toe piece 12 through one or more slots 52. The extender bar 16 attaches to the heel piece 14 through one or more slots 54. The operative length of the extender bar is maintained by provided it with multiple openings 56 along its length. A locking pin 58 is provided on either the heel or toe piece that engages one of the multiple openings 56 and maintains the position of the extender bar 16. In the embodiment shown, the locking pin 58 is provided on the heel piece 14 and an actuatable spring clip 60 is provided to hold the locking pin in the desired opening 56. It should be appreciated that the pin can be held in place through a variety of other means, including providing a threaded pin and threaded receptacle to hold it in place, providing a self-locking pin, etc. A lip 62 or other stopping means should be provided on the opposite end of the extender bar 16 to help hold it in place.

Figure 15:
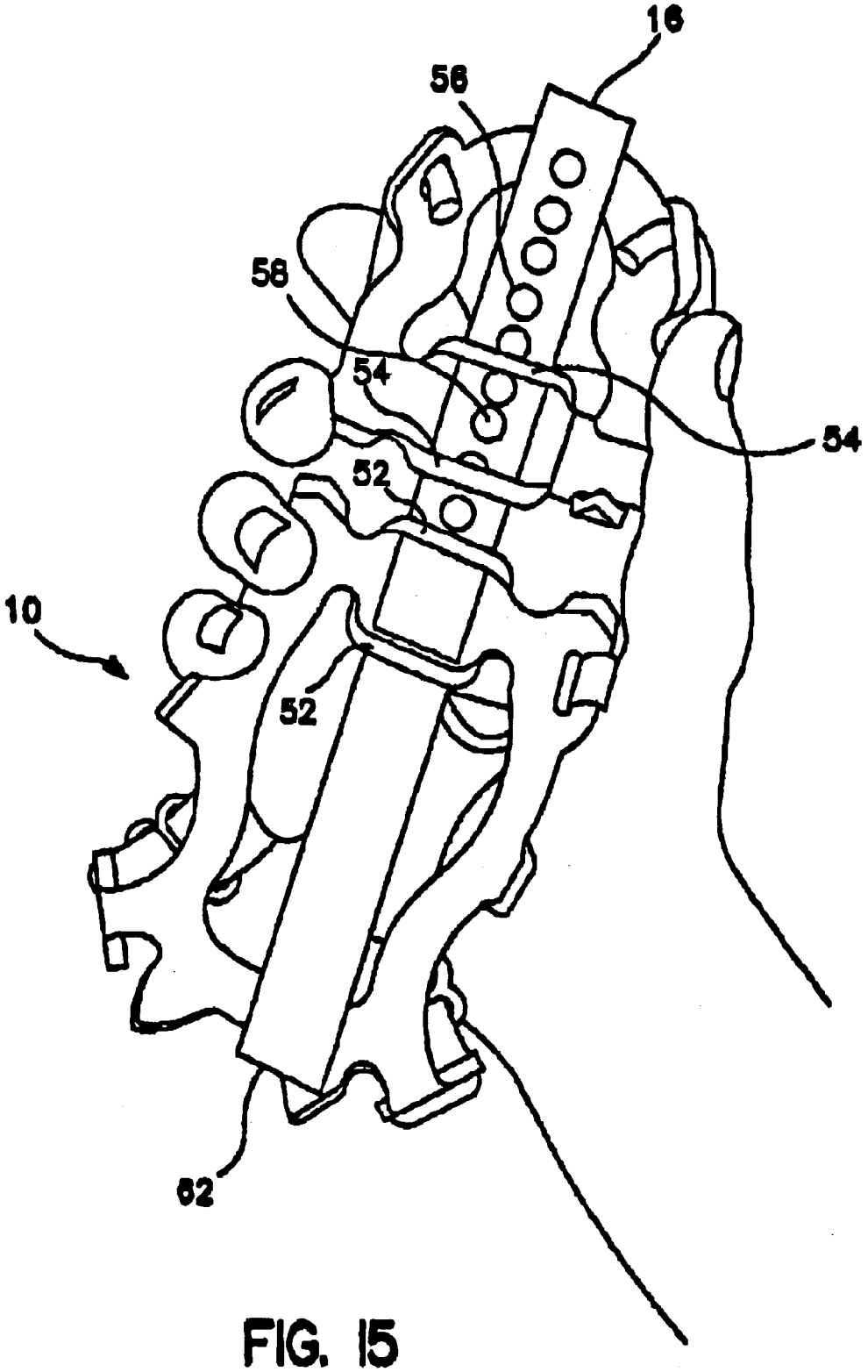
FIG. 15 is a bottom view of the traction system of the present invention shown compacted.

By providing an extender bar 16 that can be locked in place along its entire length, as is shown in FIGS. 1 through 4, the bar may be readily adjusted to a set operative length for any given footwear. As shown, the opposite end of the extender bar 16 can be freely moved through slot 52 to allow the toe piece and heel piece to compacted together when not in use (as is shown in FIG. 15, described below). By leaving the lip end 62 free to slide, the traction device can be quickly and easily compacted without the need to readjust the pre-set operative length when attaching to footwear. Additionally or alternatively, the toe and heel pieces can be compacted together by actuating the extender bar 16 through the locking pin 54, as previously described.

Details for each of the toe piece 12, heel piece 14, and strap guide 24 are shown in FIGS. 5 through 10.

Figure 5:
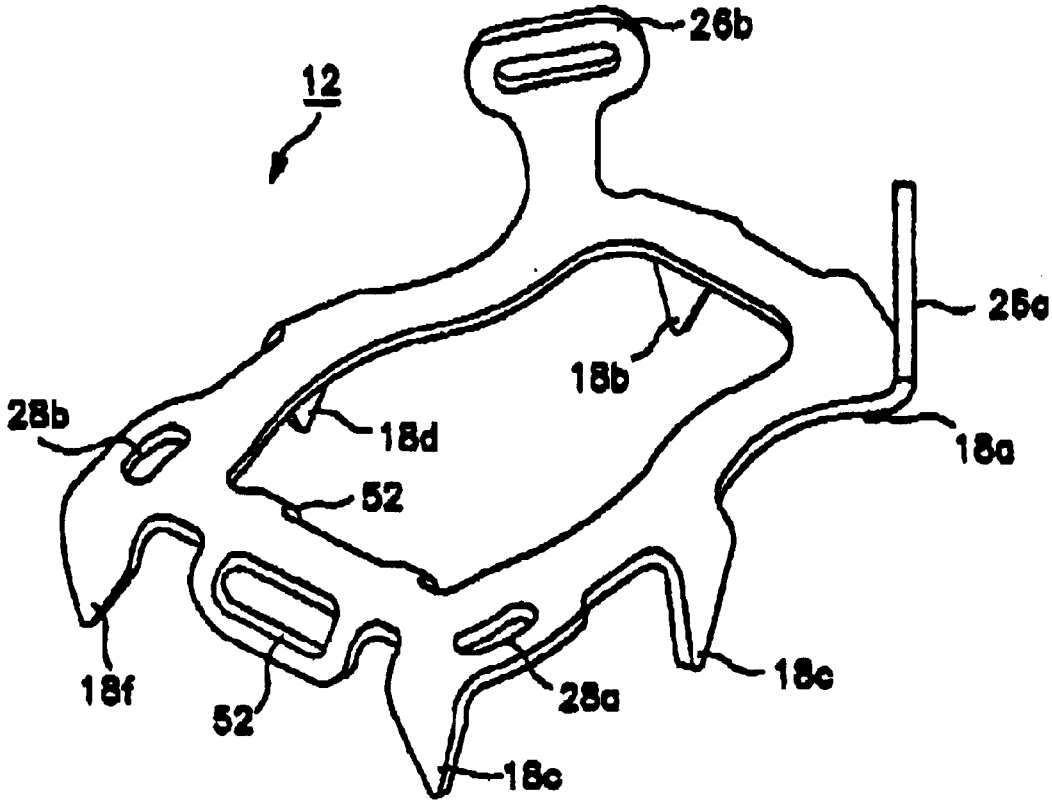
FIG. 5 is a three-quarter isometric view of a toe piece of the traction system of the present invention.
Figure 6:
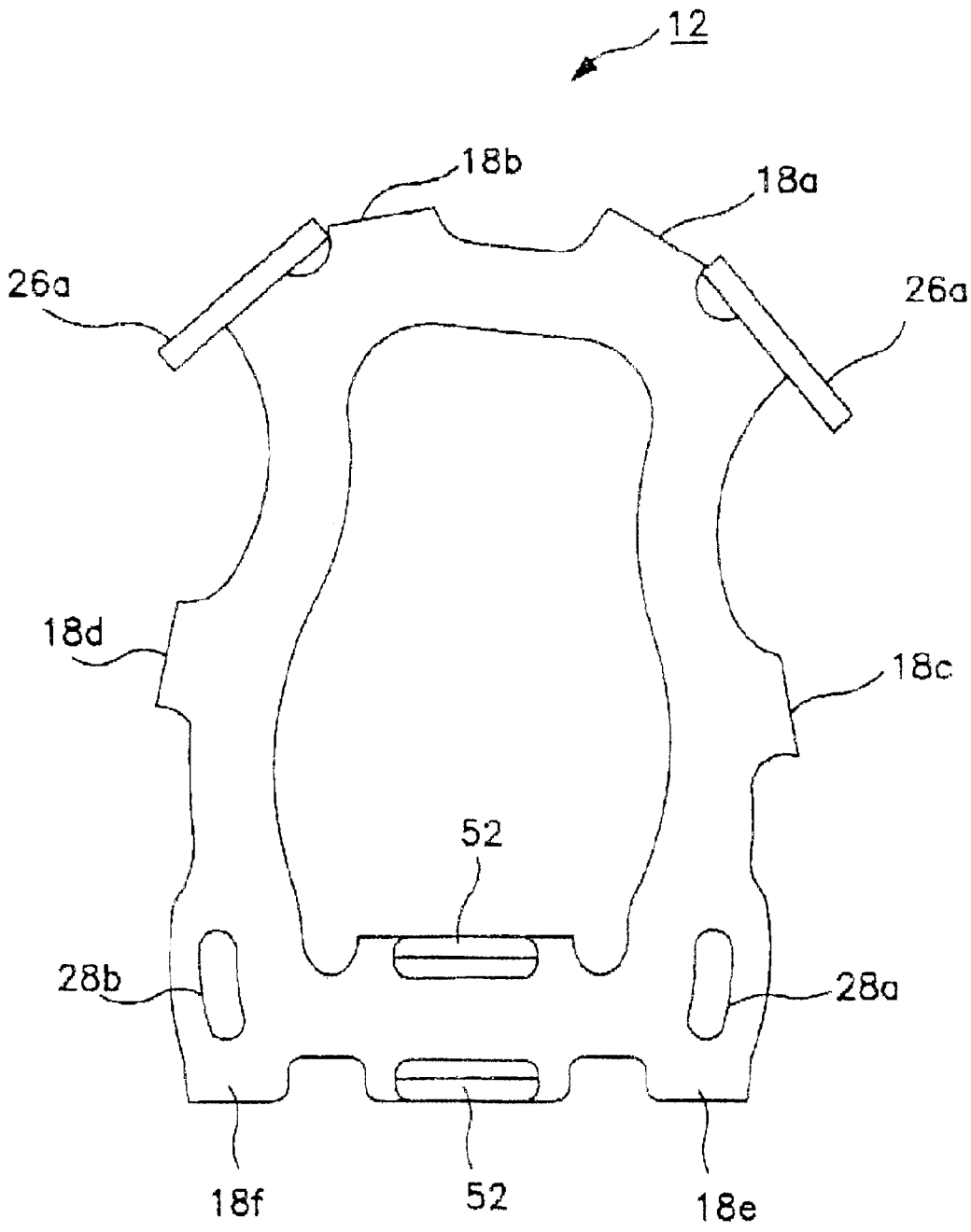
FIG. 6 is a top view of the toe piece of FIG. 5.

The toe piece 12 is shown in detail in FIGS. 5 and 6. A total of six teeth, 18*a* through 18*f* are provided, each preferably triangular in shape. The teeth preferably protrude between 0.6 and 0.8 inches from the platform of the toe piece 12. This allows for good traction with minimal snagging. They are configured so the traction is "under foot" so there is less snagging and more control. The configuration also allow for minimal "snow balling" or snow packing by using the fewest teeth necessary and allowing maximum space for the snow to exit.

The downwardly directed teeth provide the means to penetrate most slippery surfaces and gain traction. The number, shape, and orientation of the teeth can vary. For use on common footwear used for hiking or trail running it is desirable to minimize the risk of twisting an ankle, keep snow from packing in between teeth, and provide good support for the footwear that is otherwise somewhat flimsy.

The front two teeth 18*a* and 18*b* are oriented nearly perpendicular to the length of the unit. This provides optimal traction when climbing straight uphill. As is described below, the traction is enhanced by the flexing of the unit with the footwear by allowing the teeth to maintain an advantageous angle. By contrast, if the footwear or unit were rigid, the angle of the teeth into the slope would be good at the beginning of the step but as the climber lifted his or her heel in forward motion, the teeth would move to become more parallel to the slope and less traction would result. This is why crampons for rigid boots have front points nearly parallel to the length of the unit and why they are rather ineffective for traction if flexed.

The middle two teeth 18*c* and 18*d* are oriented to maximize traction while traversing a slope. They are located closer to the rear teeth than to the front teeth. This puts the teeth more "under foot" (as opposed to being near the toes of the user) and provides a sense of stability and control.

The rear two teeth 18*e* and 18*f* are oriented to be as close to the rear of the toe piece as possible without increasing the overall size of the toe piece. Again, these are located "under foot" (i.e., not far out by the edge, or beyond the edge, of most footwear and all the way to the rear of the toe piece).

As is explained in greater detail below, it is desirable that the teeth be constructed from a material that is durable, strong, relatively rigid, and sharpenable or re-shapable with a common file.

The toe piece is shaped to enhance the feeling of uninhibited walking, hiking, or running by providing a slight curve in the vertical plane. This curve also helps reduce the occurrence "snow balling" (that is, the packing of snow under foot) by reducing the angle of the front and rear teeth slightly from 90 degrees.

Figure 7:
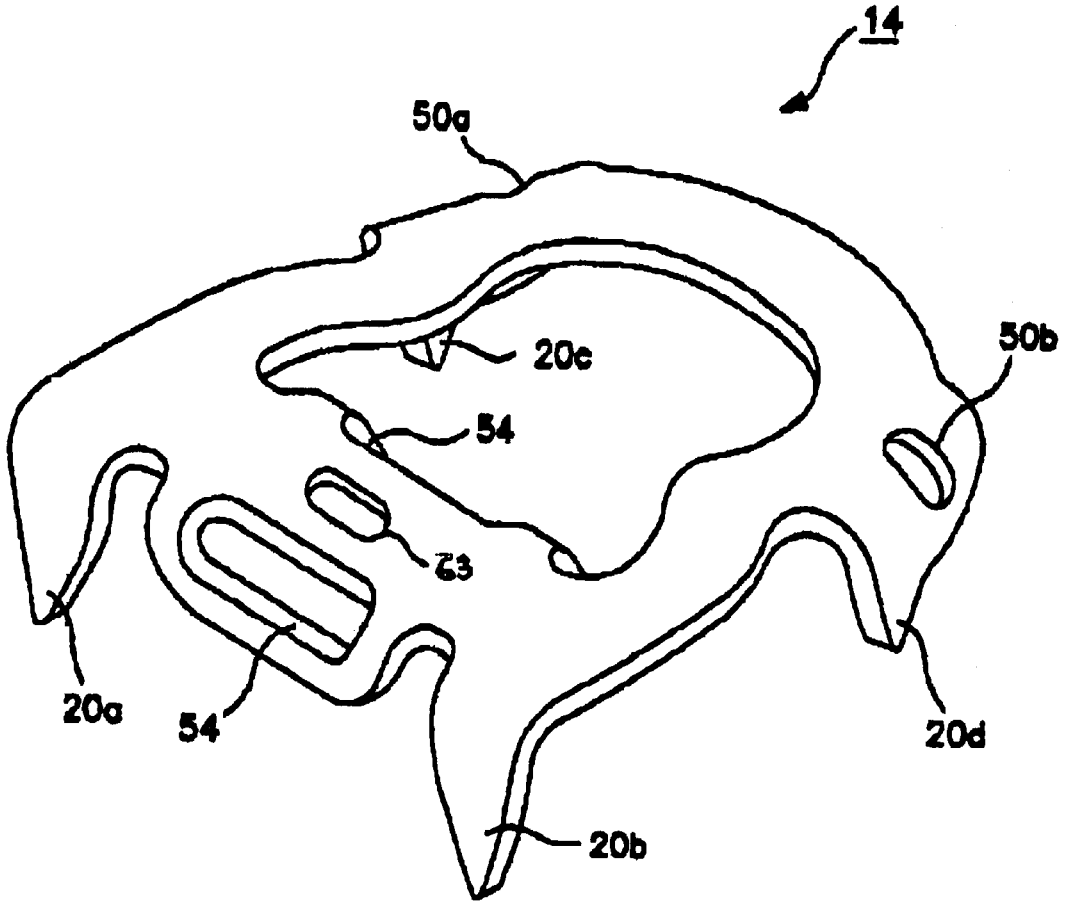
FIG. 7 is a three-quarter isometric view of a heel piece of the traction system of the present invention.
Figure 8A:
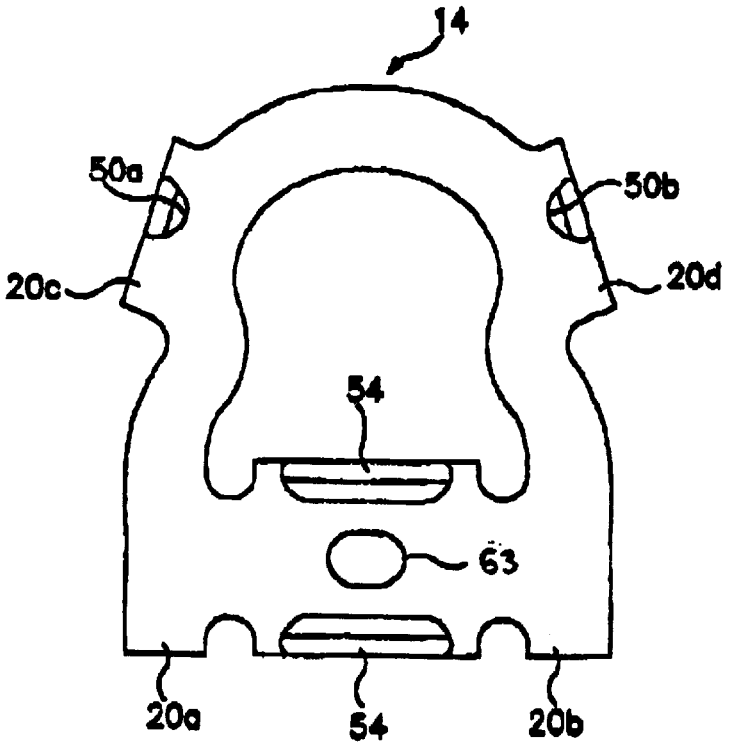
FIG. 8A is a top view of the heel piece of FIG. 7.
Figure 8B:
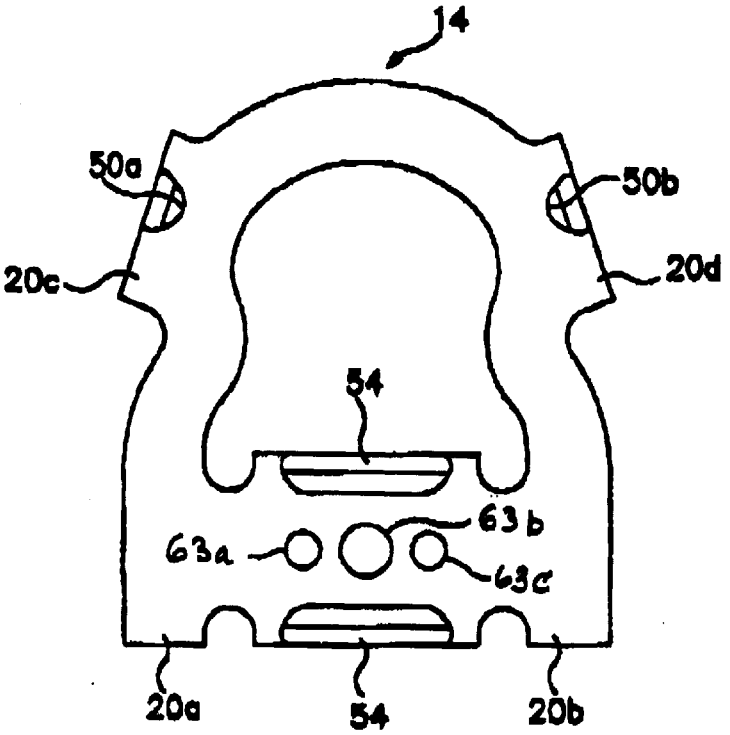
FIG. 8B is a top view of another embodiment of a heel piece of the present invention.

The heel piece 14 is shown in detail in FIGS. 7 and 8A. There are preferably four teeth 20*a*, 20*b*, 20*c*, 20*d* on the heel piece, again each triangular in shape. The teeth are configured to offer minimal risk of snagging and twisting an ankle or tripping. This is accomplished by designing the rear teeth shorter than the front teeth 18 (e.g., approximately 0.4 to 0.6 inches in length) and keeping the overall size of the heel piece to a minimum. A pin slot 63 is provided to allow for actuation of the locking pin 58 through the heel piece. Again, the teeth are preferably formed of a material that is durable, relatively rigid, and capable of being sharpened and re-shaped as needed. Another embodiment of the heel piece 14 is illustrated in FIG. 8B showing an alternative embodiment of pin slot 63 comprising three openings 63*a*, 63*b*, 63*c*.

It is preferred that the toe piece and heel piece be constructed from a lightweight, relatively inflexible, yet durable material, such as stainless steel, aluminum, titanium, plastic, or composite material. Due to cost constraints, the preferred material is aluminum alloy, such as 7075 TC aluminum, available from AMI Metals of California, approximately 0.14 to 0.17 inches thick.

Figure 9:
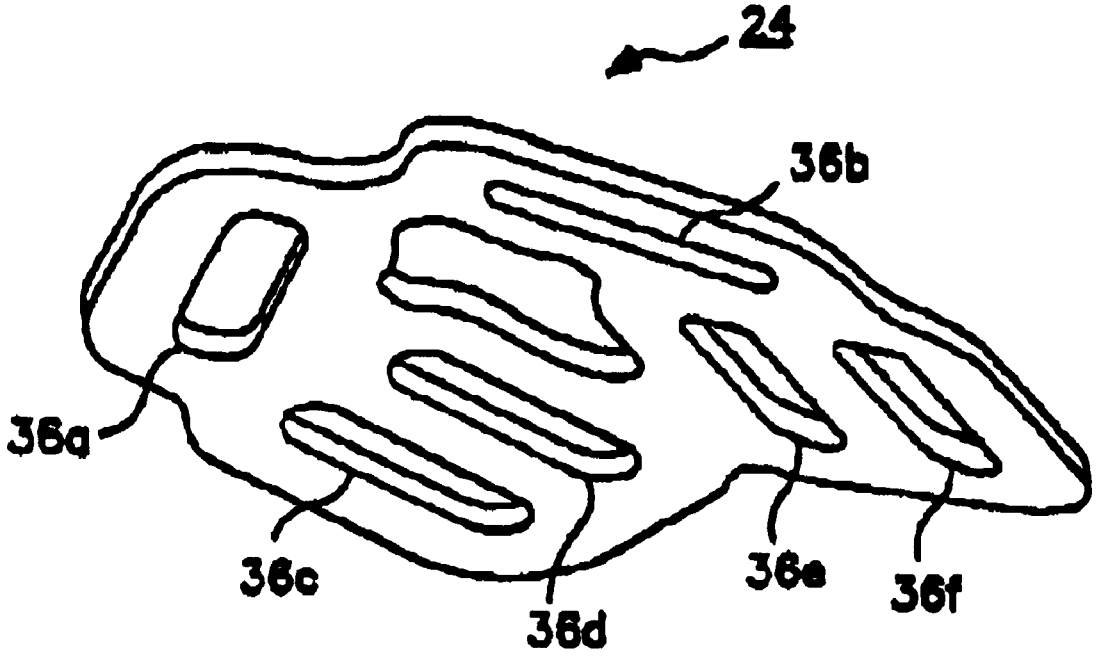
FIG. 9 is a three-quarter isometric view of a strap guide of the traction system of the present invention.
Figure 10:
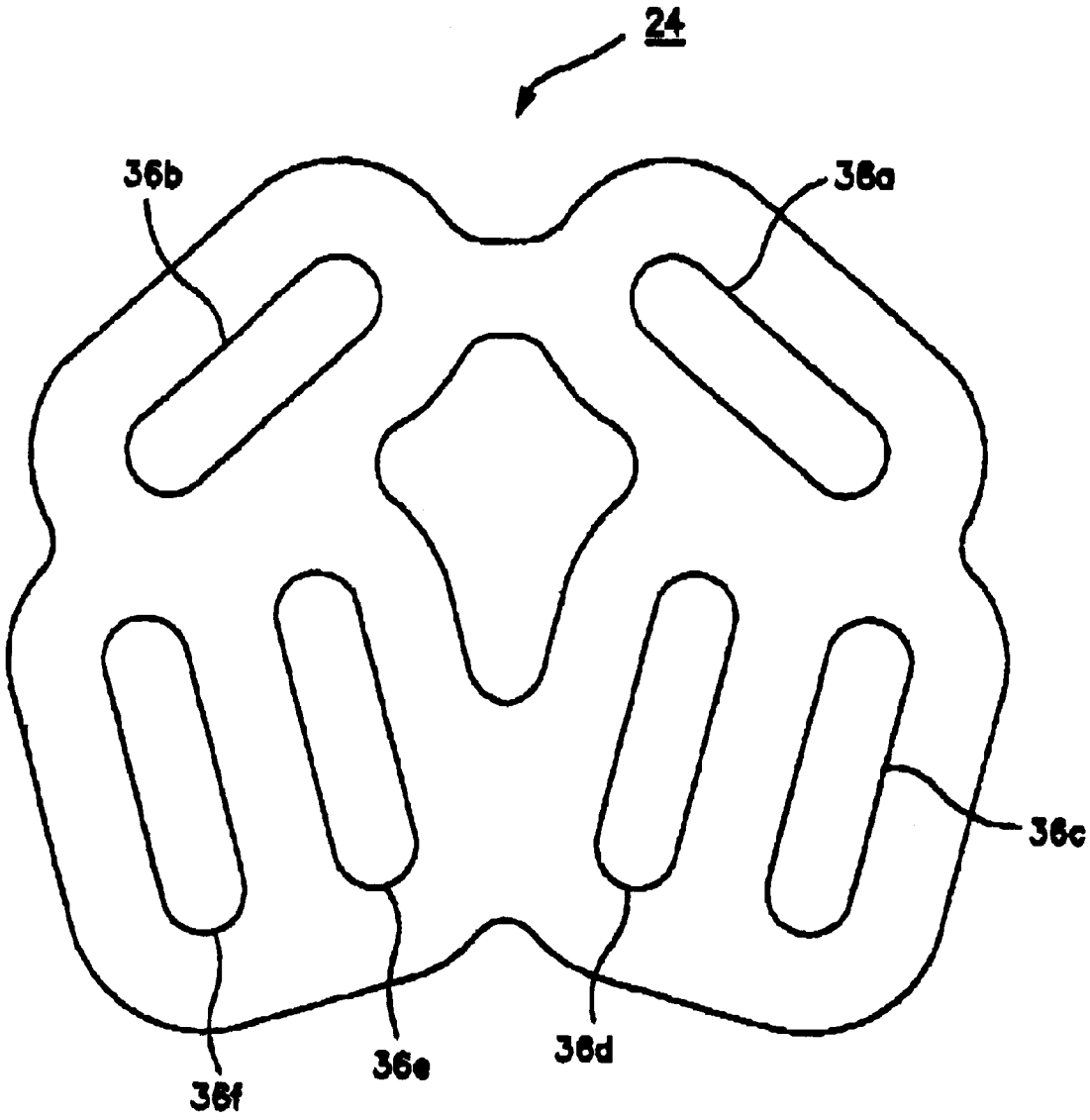
FIG. 10 is a top view of the strap guide of FIG. 9.

The strap guide 24 is shown in FIGS. 9 and 10. The strap guide is preferably constructed from a strong yet flexible material, such as high density polyethylene (HDPE) or ultra-high molecular weight (UHMW) polyethylene. The preferred material comprises an UHMW polyethylene approximately 0.05 to 0.2 inches thick, and more preferably about 0.08 to 0.15 inches thick.

The strap guide can be adjusted for varying sizes of footwear and keeps straps from shifting to an insecure position. An alternative way to solve this problem is to sew (or otherwise bond) the straps together at the crossover point. This works only for a limited size range of footwear unless a variable length feature is added between the support tab and the crossover point. This can be accomplished by allowing extra length of the strap at the slotted tabs 26 that can be used to extend this length. This may be less convenient to change than by use of the strap guide. Furthermore, the strap guide provides a way of "redirecting" the strap to optimize the fit of the strap system. The strap angle can be changed slightly as the strap passes through the strap guide. The better fit is achieved because the straps do not cross in a symmetric "X" pattern and the "redirecting" of the straps helps account for that asymmetry. The strap guide can be designed to accommodate a range of geometries in the toe piece. Further, the strap guide may be readily readjusted when the user changes to a different type of footwear that has a lower or higher toe profile. The strap guide is designed to provide enough friction on the strap to keep the crossover point from slipping forward into an insecure position. This is achieved by threading the strap through a series of slots.

The strap material and dimensions used with the present invention may be varied for various applications. Generally suitable materials include: various plastics (such as polypropylene, nylon, KEVLAR® polyimide), leather, cotton, hemp, or any similar flexible strap material. Polypropylene is preferred since it does not absorb water and freeze, as nylon and natural materials do, and is easier to process and cheaper than polyimide. The width dimensions can vary from about 0.25 to 1.25 inches, with a width of about 0.75 inches being generally preferred. Thickness can vary from about 0.03 to 0.1 inches. "Heavy duty" grade polypropylene has been shown to work well.

Constructed from reasonably priced light weight materials, the traction system of the present invention can readily attain a total weight per individual foot unit of about 0.7 lbs. or less, and more preferably a total weight of less than about 0.6 lbs. or even less than about 0.5 lbs.

Figure 11:
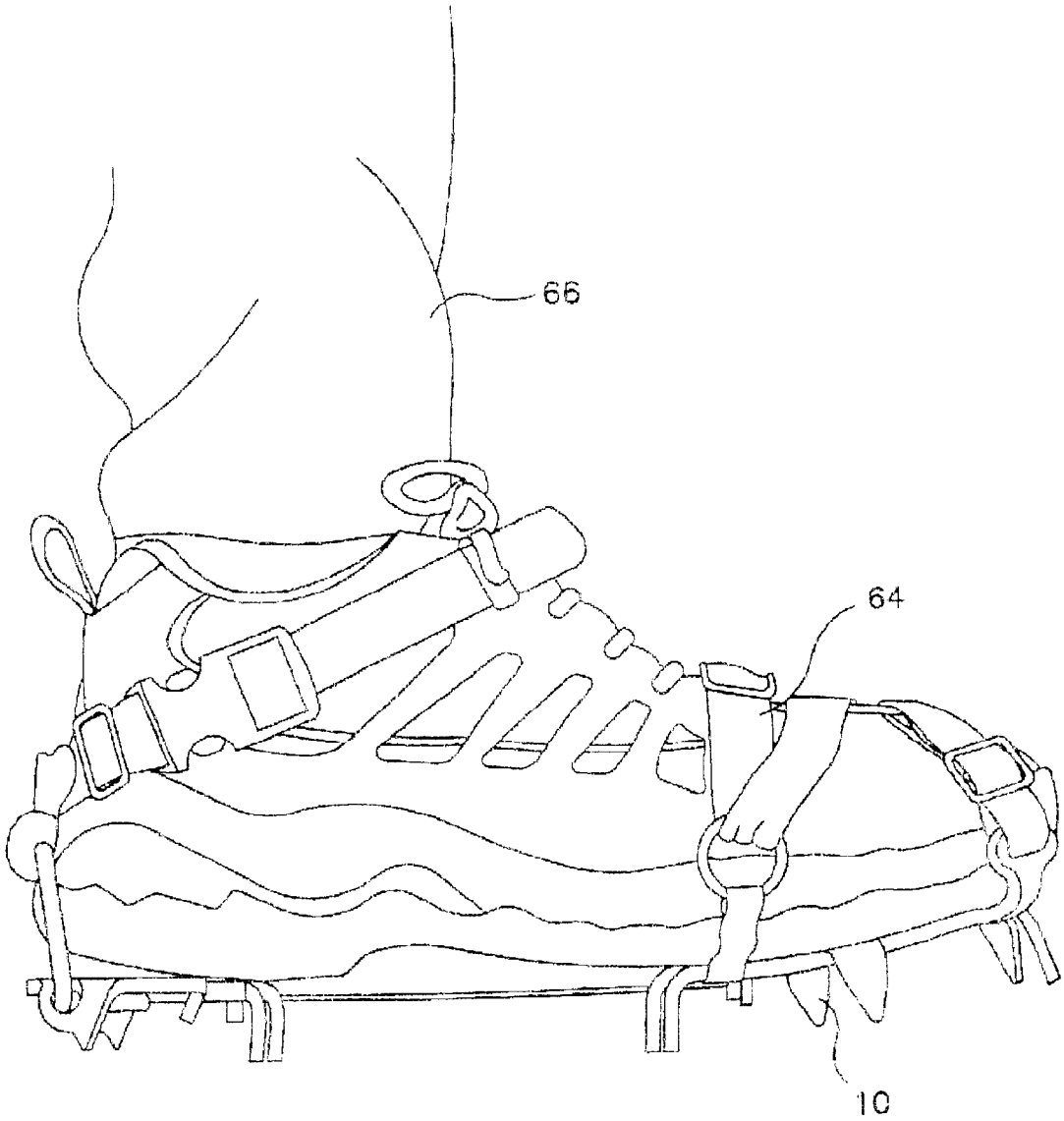
FIG. 11 is a side view of the traction system of the present invention shown attached to a running shoe and worn during a run in snow.
Figure 12:
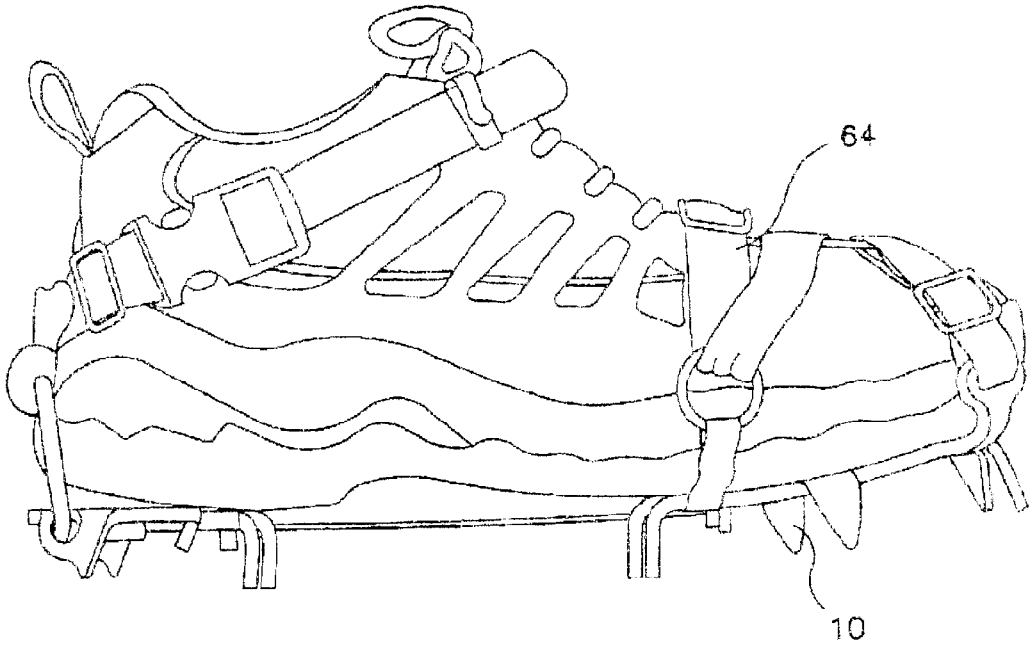
FIG. 12 is a side view of the traction system of the present invention shown attached to a running shoe.
Figure 13:
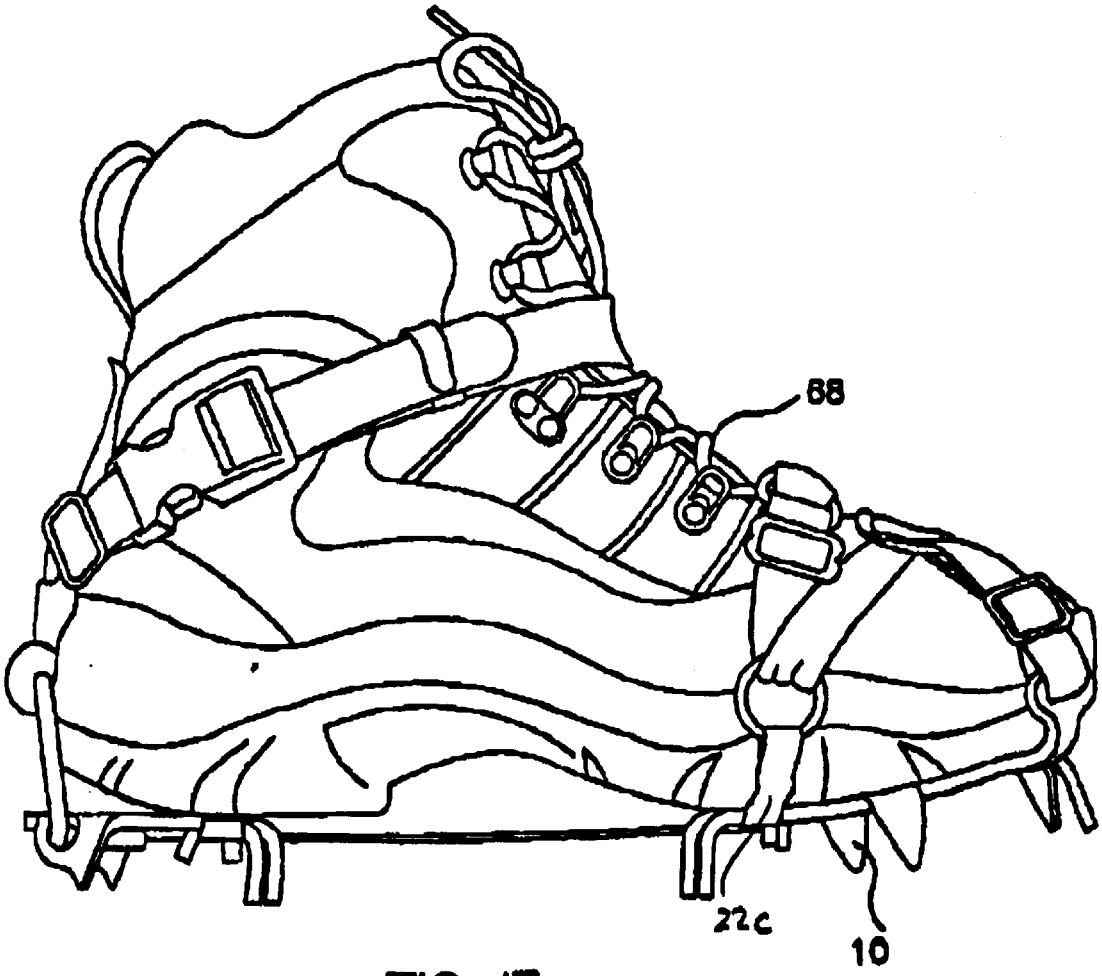
FIG. 13 is a side view of the traction system of the present invention shown attached to a lightweight hiking boot.
Figure 14:
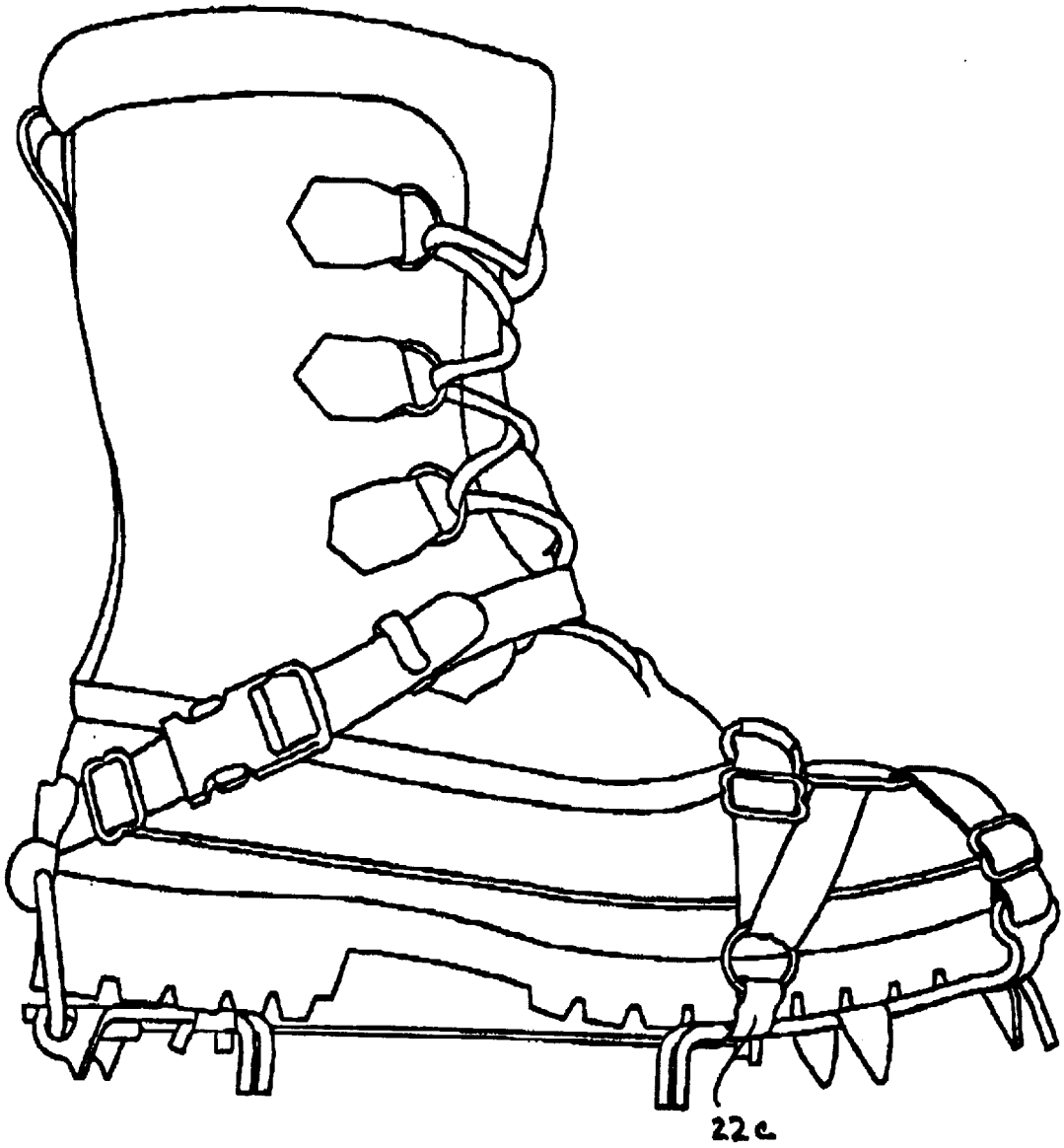
FIG. 14 is a side view of the traction system of the present invention shown attached to a pack boot.

As is shown in FIGS. 11 through 14, the traction system 10 of the present invention can be used in a variety of applications on a wide range of footwear products. FIG. 11 demonstrates use of the traction system 10 on a trail running shoe 64 of a wearer 66 traversing snow. FIG. 12 again shows the system 10 on a trail running shoe 64. FIG. 13 shows the system 10 on a lightweight hiking boot 68. It should be noted that such boots 68 normally have relatively flexible soles that would not be suitable for attachment of mountaineering-type crampon devices. FIG. 14 shows the system 10 attached to a pack boot 72. Again, pack boots 72 have relatively flexible soles that are not suitable for mountaineering-type crampons. As can be seen in FIGS. 11 through 14, the side support straps 22*c* assume different orientations to accommodate the different widths of each of these shoes.

One of the important features of the traction system 10 of the present invention is its flexibility. By using a flexible material as the extender bar 16, the system can be designed to mimic the flexibility of flexible footwear, making it suitable for use with street shoes as well as walking, running, and lightweight hiking footwear. However, the system can be equally well used with rigid soled shoes, such as stiff hiking or mountaineering boots.

FIG. 15 illustrates that the traction system 10 of the present invention can be readily shortened into a relatively small, compact unit by sliding the extender bar 16 through slots 52. In this compacted form the traction system 10 of the present invention can be easily stored and transported. The extender bar 16 can then be readily slid into the open position until lip 62 engages with slot 52 in the fully open position. In this way once the unit is adjusted to fit a given shoe it can be compacted and returned to its full operational length without altering spring clip positions.

Shown in FIG. 16 is a demonstration of the excellent flexibility of the system 10 of the present invention. Using only minimal manual pressure, the toe piece 12 can be flexed up to 60 degrees or more from normal plane 72 without damaging or permanently deforming the system 10. Depending on the materials used, manual flexibilities of 10, 15, 20, 25, 30, 35, 40, 45, 50, 55, 60, 65, 70, 75, 80, 85, 90, or more degrees can be readily achieved with the present invention.

Figure 17:
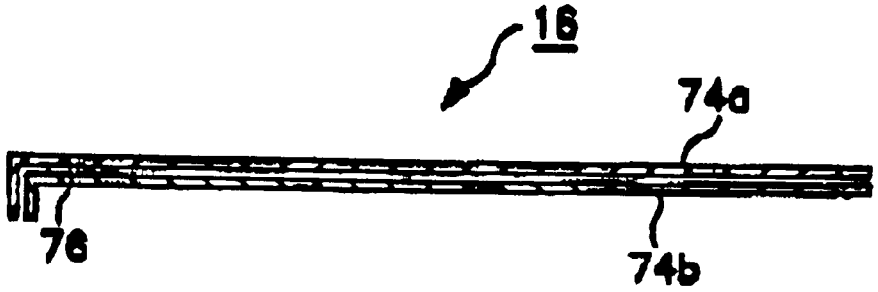
FIG. 17 is a side view of another embodiment of an extender bar of the present invention comprising multiple layers.
Figure 18:
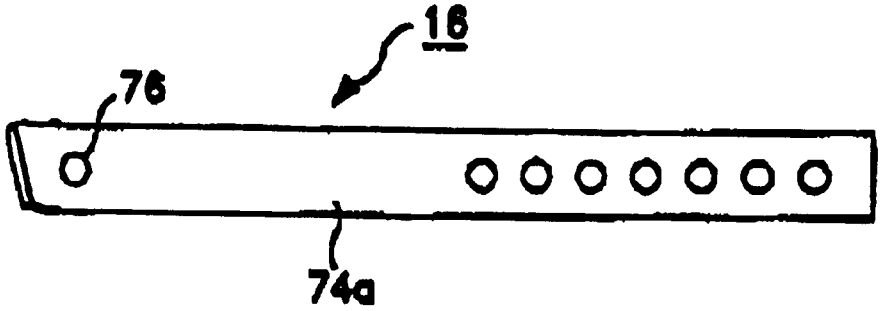
FIG. 18 is a top view of the extender bar of FIG. 17.

One method of achieving flexibility is to construct the extender bar 16 from a single layer of flexible material, such a spring steel, alloy, or plastic. As is shown in FIGS. 17 and 18, flexibility can also be achieved or enhanced by forming the extender bar 16 from multiple layers (e.g., 2, 3, 4, or more layers) of material 74*a*, 74*b* that are attached together, such as through adhesion or welding at one or more discrete points 76. This construction can provide excellent flexibility and durability with minimal weight, minimal thickness, and minimal strain applied to the extender bar during use.

Figure 19A:
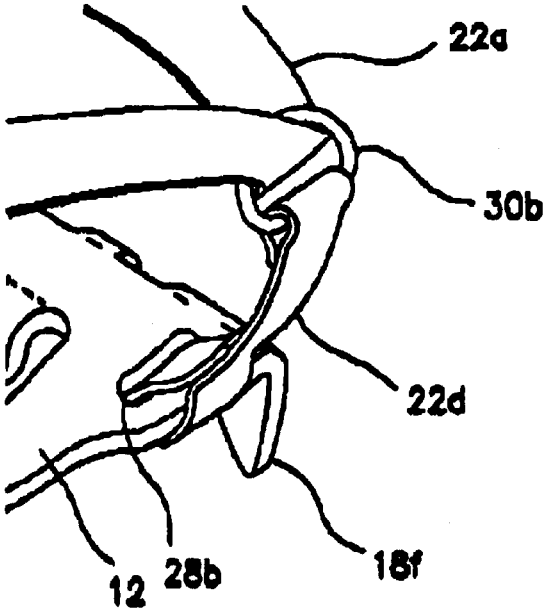
FIG. 19A is an enlarged perspective view of side support strap 22*d*, shown in an upright position assumed when attached to narrower footwear.
Figure 19B:
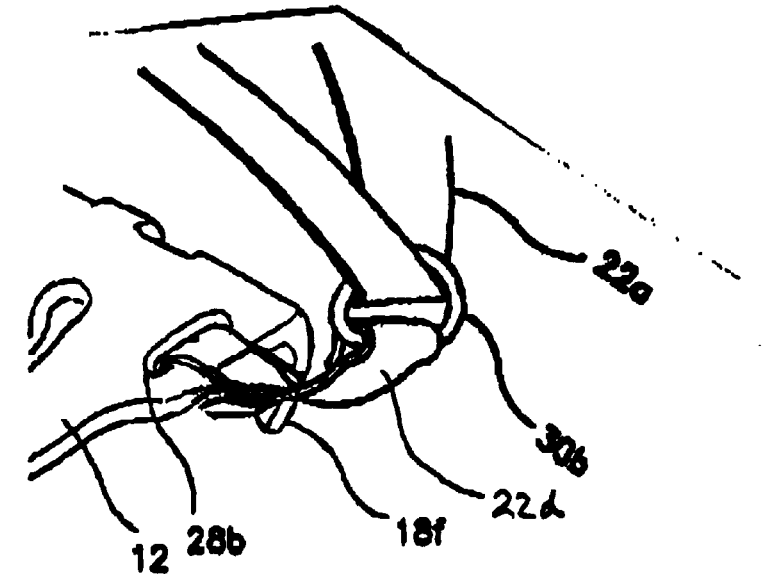
FIG. 19B is an enlarged perspective view of side support strap 22*d*, shown in a outward position assumed when attached to wider footwear.

FIGS. 19A and 19B illustrate how the side support straps 22*c* and 22*d* of the present invention can be adjusted to accommodate different widths of footwear. As is shown in FIG. 19A, side support strap 22*d* is set in a relatively upright position that provides lateral stability and better fit against narrower footwear, such as the running shoe shown in FIG. 11. By contrast, the side support strap 22*d* also can assume a flatter outward orientation, essentially extending the width of the footbed, as is shown in FIG. 19B. In this orientation the side support strap 22*d* provides a wider and more stable footbed so as to support a much wider shoe, such as the pack boot shown in FIG. 14.

Figure 20A:
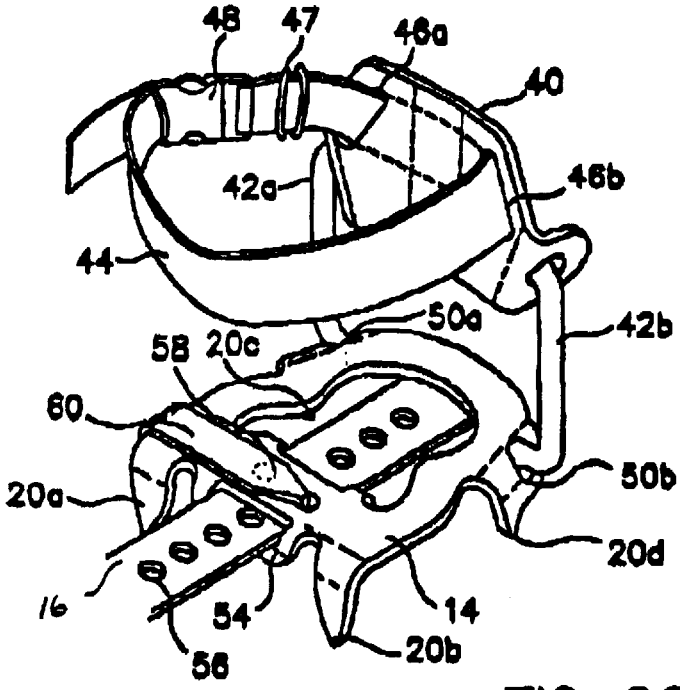
FIG. 20A is an enlarged three-quarter top view of the heel piece of the present invention showing a first embodiment of a spring clip mechanism of the present invention.
Figure 20B:
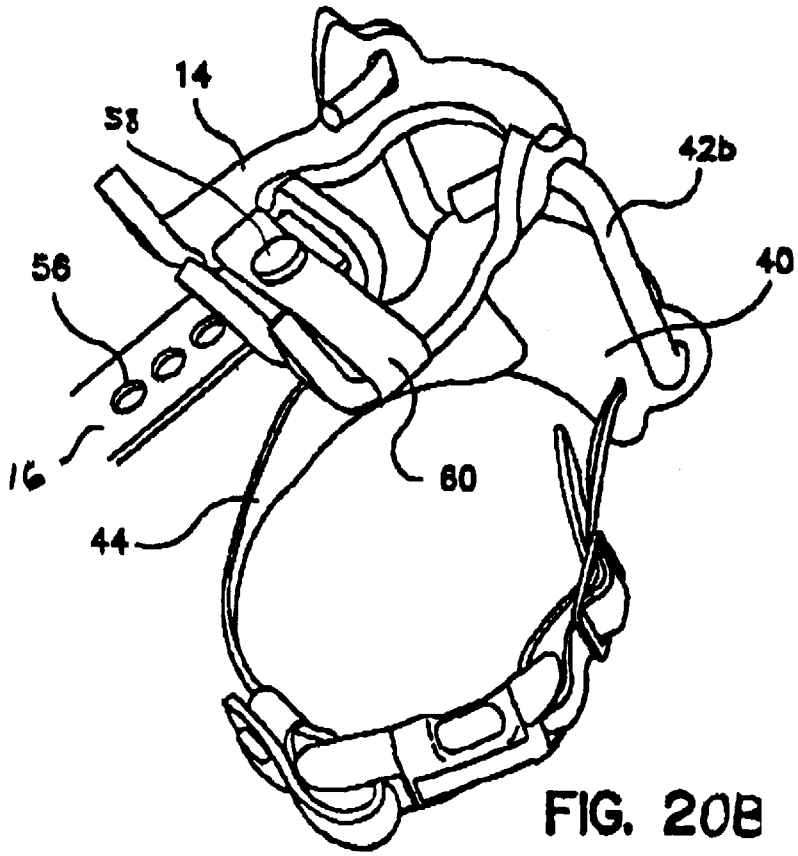
FIG. 20B is an enlarged three-quarter bottom view of the heel piece of FIG. 20A.
Figure 21A:
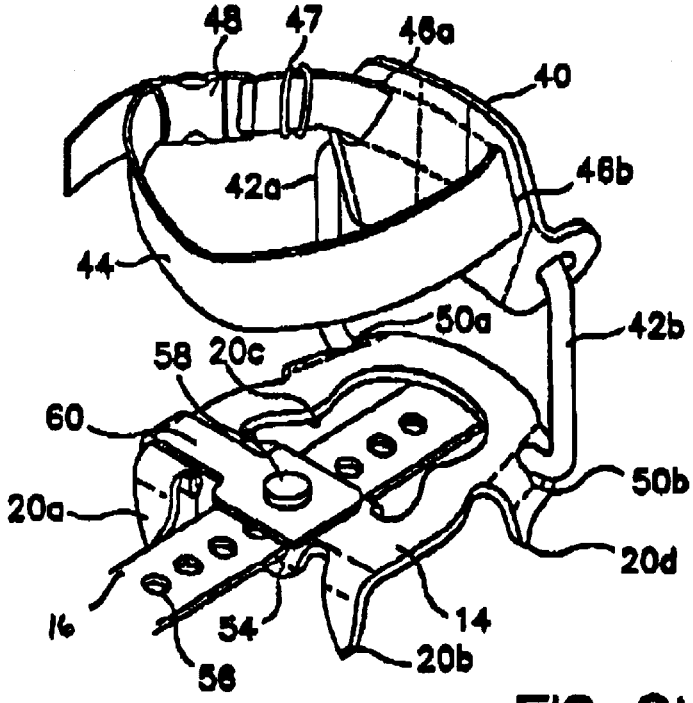
FIG. 21A is an enlarged three-quarter top view of the heel piece of the present invention showing a second embodiment of a spring clip mechanism of the present invention.
Figure 21B:
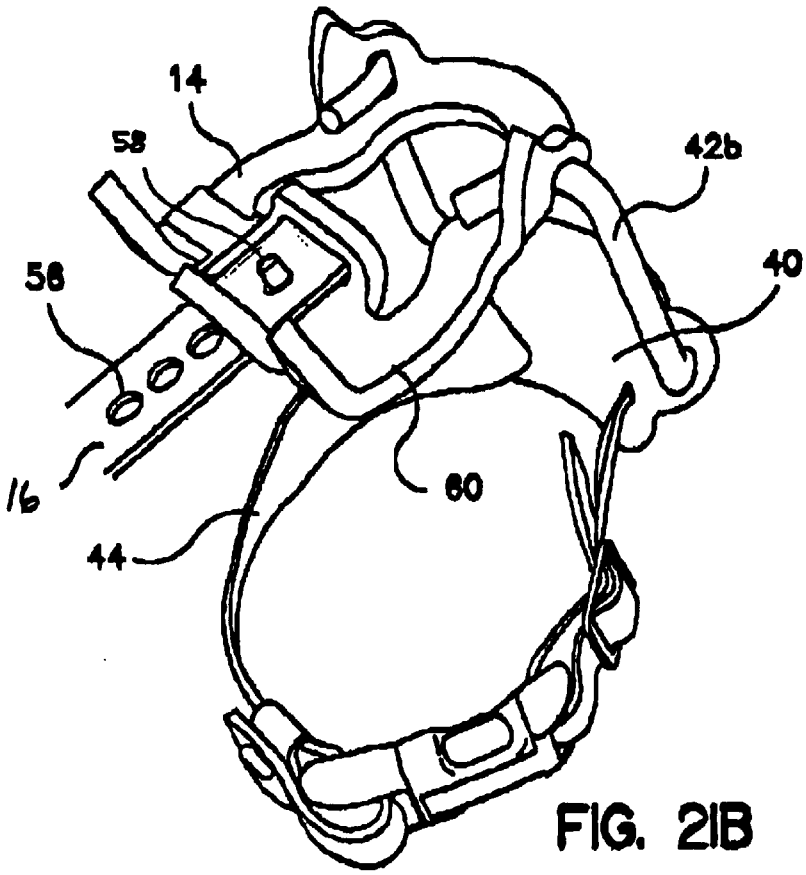
FIG. 21B is an enlarged three-quarter bottom view of the heel piece of FIG. 20A.

Two different embodiments of spring clips for use in the present invention are illustrated in detail in FIGS. 20 and 21. FIGS. 20A and 20B show in detail the spring clip embodiment previously shown and described with respect to FIGS. 1 through 4. In this embodiment the locking pin 58 is oriented so as to be pointed upward into the openings in the extender bar 16. FIGS. 21A and 21B show in detail an alternative construction whereby the locking pin 58 is oriented so as to be pointed downward through the openings in the extender bar 16.

Figure 22:
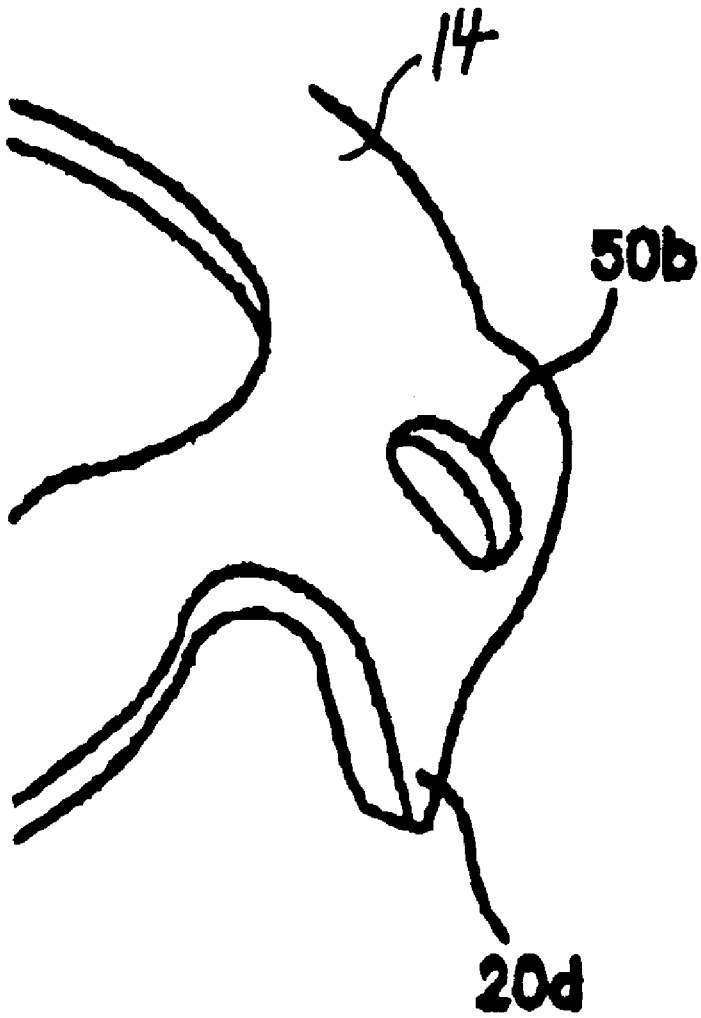
FIG. 22 is an enlarged section view of tooth 20B and heel bale attachment opening 50*b*.

FIG. 22 illustrates opening 50*b* used to attach the heel bale to heel piece 14 of the present invention. Preferably opening 50*b* should be shaped so as to allow the heel bale to be actuated between an folded orientation and an upright operative orientation.

Without intending to limit the scope of the present invention, the following example illustrates how the present invention can be made.

EXAMPLE

A traction system of the present invention has been constructed in accordance with the design illustrated in FIGS. 1 through 10 in the following manner from the following materials:

Flat aluminum blanks for the toe piece 12 and heel piece 14 are made from sheets of aluminum alloy. Blanks can be made from 7075 aluminum (T6 or T0 temper) with a thickness of about 0.16 inch and can be milled or cut with laser or water jet. These blanks are formed in dies. The first die rounds over any burrs on the edges, the second bends the teeth and extender bar tabs down and front support tabs up. The third bends a "rocker" into the toe piece. If T6 temper is used, the blanks should be solutionized and quenched before forming.

The plastic strap guide 24 and heel cup 40 are milled from UHMW polyethylene about 0.09 inches and about 0.125 inches thick, respectively. They are heated in an oven then formed and cooled.

The extender bar 16 can be fabricated from a sheet of annealed heat treatable steel alloy, such as type 4130 or 4140, about 0.06–0.07 inch thick, by shearing to size (approximately 0.75 inches×8 inches), forming, drilling the holes, heat treating to a spring temper, and powder coating to finish. Other steels can be used in place of the heat treatable alloys (for example, type 1045 medium carbon steel).

Alternatively, a multi-layer extender bar can be fabricated from two or more thinner members. For example, two layers of 301 Full Hard stainless steel, about 0.03 inches thick, can be fabricated from sheets or strips to approximately 0.75 inches×8 inches and holes drilled. These members are then permanently joined by a single spot weld or other type of permanent bond.

The side supports 22*c*, 22*d* on the toe piece can be a 316 stainless steel in the annealed condition of about 0.024 inch thickness. This material is cut to about 0.42×3.1 inches then formed. The formed piece is then spot welded to a "D"-ring on one end and the body of the toe piece on the other.

The heel bale 42 is formed from a 0.204 inch diameter 316L ⅛ hard stainless steel round in a series of bending jigs. The plastic heel cup 40 is then assembled onto the bale 42 then the bale is assembled to the heel piece 14 using special tooling that allows the bale to be inserted and bent into its final position.

The spring clip 60 is cut by water jet or laser into flat blanks from about 0.03 inch thick 301 FH stainless steel. The clip is formed in a jig to add about a 170 degree curve. The curve is then increased to about 180 or more degrees by a second clamping process that assures a snug fit to the heel piece 14. Once the spring clip is attached to the heel piece, the pin 58 is added by inserting the pin in the hole in the spring clip and hammering the pin with a pneumatic hammer into a bottoming hole. This expands the diameter of the pin and secures it in place.

To assemble the entire unit, the extender bar 16 is inserted through the front tabs 52 and connected to the heel piece 14 by lifting the spring clip 60 and sliding the extender bar 16 into the rear tabs 54. A strap 44 is added to the heel cup 40 by threading them through the slots 46 provided and fastening them with a releasable buckle 48. Two straps 22*a*, 22*b* are added to the toe piece 12 by attaching them to the front anchors 26*a*, 26*b* on the toe piece and threading them through the strap guide 24 and the 'D'-rings 30*a*, 30*b* on the side supports 22*c*, 22*d* of the toe piece then a buckle 34 to hold straps snug on the footwear.

The traction system constructed in this manner demonstrated excellent performance when worn with a variety of footwear, including running shoes, street shoes, light hiking boots, and pack boots. This traction system has provided excellent traction on loose dirt, loose snow, packed snow, and ice.

The traction system manufactured in accordance with this example could be readily manually flexed in the manner shown in FIG. 16 up to 60 degrees or more without damaging or permanently deforming the system.

The traction system constructed in this manner weighed only about 1.2 lbs. for the pair.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A traction system oriented in a normal plane and adapted to be attached to common footwear comprising a forefoot region constructed of a relatively inflexible material having multiple spikes; a heel region constructed of relatively inflexible material having multiple spikes; a flexible linkage made of a springy material between the forefoot region and the heel region that allows the forefoot region and the heel region to be flexed relative to each other at least 20 degrees from normal plane without damaging or permanently deforming the system; and a strap or harness attachment adapted to secure the traction system to common footwear.

2. The traction system of claim 1 wherein the flexible linkage comprises an extender bar having multiple layers of material attached together.

3. The traction system of claim 1 wherein the flexible linkage allows the forefoot region and the heel region to be flexed relative to each other at least 45 degrees.

4. The traction system of claim 1 wherein the flexible linkage allows the forefoot region and the heel region to be flexed relative to each other at least 90 degrees.

5. The traction system of claim 1 wherein the traction system further includes a strap guide that acts to keep the straps from shifting to an insecure position.

6. An improved strapping system for attaching a device to footwear comprising a strap guide; a toe piece on the device having at least four strap anchors attached thereto; an extender bar made of a springy material attached to said toe piece; at least two individually length-adjustable straps, each attached between two or more of the strap anchors and the strap guide; wherein the straps are adapted to be adjusted to position the strap guide in a secure position over a wearer's forefoot region; and wherein the strap guide acts to keep the straps from shifting to an insecure position.

7. The improved strapping system of claim 2 wherein the strapping system further includes a heel region and a flexible linkage including said extender bar between the toe piece and the heel region.

8. The improved strapping system of claim 7 wherein the extender bar has multiple layers of material attached together.

9. The improved strapping system of claim 7 wherein the flexible linkage allows the toe piece and the heel region to be flexed relative to each other at least 45 degrees from normal plane without damaging or permanently deforming the system.

10. The improved strapping system of claim 2 wherein the strap guide includes multiple openings therein and the straps attach between the strap anchors and the openings in the strap guide.

11. A traction device adapted to be attached to footwear having a toe piece and a heel piece comprising a heel support, movably attached to the heel piece, shaped to allow the heel support to fold forward fully against the heel piece for compactibility while providing rigid support when extended from the heel piece in use, and an extender bar made of springy material attached to the heel piece.

12. The traction device of claim 11 wherein the traction device further includes a toe piece and a flexible linkage including the extender bar between the toe piece and the heel piece.

13. The traction device of claim 12 wherein the flexible linkage allows the toe piece and the heel piece to be flexed relative to each other at least 45 degrees from normal plane without damaging or permanently deforming the system.

14. The traction device of claim 12 wherein the extender bar has multiple layers of material attached together.

15. The traction device of claim 11 wherein the heel support comprises a pair of bales pivotally attached to the heel piece creating a rigid stop when rotated to the upright position.

16. A traction system having a toe piece comprising at least one relatively inflexible strap pivotally attached to the toe piece; at least one flexible strap attached around the wearer's foot and to the relatively inflexible strap; wherein the relatively inflexible strap provides lateral support to the wearer's foot during use, and an extender bar made of a springy material attached to the toe piece.

17. The traction system of claim 16 wherein the relatively inflexible strap comprises a metal strip.

18. The traction system of claim 16 wherein the relatively inflexible strap pivots outwardly from the toe piece to provide an extended footbed for the wearer's foot.

19. The traction system of claim 18 wherein the relatively inflexible strap comprises a metal material.

20. The traction system of claim 16 wherein the traction system further includes a strap guide that acts to keep the flexible strap from shifting to an insecure position during use.

21. A traction device including an extender bar made of a springy material connecting a toe piece to a heel piece comprising the extender bar having multiple layers of material that are attached together.

22. The traction device of claim 21 wherein the extender bar comprises two layers of material that are connected together only at distinct points.

23. The traction device of claim 22 wherein the two layers of material comprise a metal.

24. The traction device of claim 21 wherein the extender bar allows the toe piece and the heel piece to be flexed relative to each other at least 45 degrees.

25. The traction system of claim 21 wherein the extender bar allows the toe piece and the heel piece to be flexed relative to each other at least 90 degrees.

26. A traction device having a toe region, a heel region, and an extender bar made of a springy material attaching together the toe region and the heel region, the traction device including a top surface adapted to contact a wearer's footwear and an opposing bottom surface, comprising a spring clip attached to either the toe region or the heel region adapted to adjustably anchor the extender bar in relative position between the toe region and the heel region; wherein the extender bar has a length; wherein the spring clip is adapted to actuate in a direction essentially perpendicular to the length of the extender bar; and wherein the spring clip is positioned to actuate away from the bottom surface so that the position of the extender bar, toe region, and heel region can be adjusted relative to each other while the traction device is attach to the wearer's footwear.

27. The traction system of claim 26 wherein the extender bar comprises multiple layers of material attached together.

28. The traction system of claim 26 wherein the extender bar includes a series of openings formed along its length and the spring clip includes a protrusion adapted to engage at least one of the openings so as to maintain the position of the toe region and the heel region relative to each other.

29. The traction device including an extender bar made of springy material connecting a toe piece to a heel piece comprising the extender bar having multiple layers of material; wherein the extender bar between the toe piece and the heel piece allows the toe piece and the heel piece to be flexed relative to each other at least 20 degrees from normal plane without damaging or permanently deforming the extender bar.

30. The traction device of claim 29 wherein the extender bar comprises multiple layers of material that are attached together at at least one point.

31. The traction device of claim 29 wherein the extender bar comprises two layers of material that are connected together only at distinct points.

32. The traction device of claim 29 wherein the extender bar comprises a metal.

33. The traction device of claim 29 wherein the extender bar allows the toe piece and the heel piece to be flexed relative to each other at least 45 degrees.

34. The traction system of claim 29 wherein the extender bar allows the toe piece and the heel piece to be flexed relative to each other at least 90 degrees.

* * * * *

UNITED STATES PATENT AND TRADEMARK OFFICE

CERTIFICATE OF CORRECTION

PATENT NO. : 6,742,286 B2
APPLICATION NO. : 10/053049
DATED : June 1, 2004
INVENTOR(S) : Daniel G. Giovale It is certified that error appears in the above-identified patent and that said Letters Patent is hereby corrected as shown below:

Column 10, line 50 for line 1 of Claim 7 “2” should be --6--;

Column 10, line 62 for line 1 of Claim 10 “2” should be --6--;

Signed and Sealed this

Twenty-first Day of November, 2006

JON W. DUDAS
*Director of the United States Patent and Trademark Office*